US008092570B2

(12) United States Patent
Boulos et al.

(10) Patent No.: US 8,092,570 B2
(45) Date of Patent: Jan. 10, 2012

(54) METHOD FOR PRODUCING TITANIUM METAL

(75) Inventors: Maher I. Boulos, Sherbrooke (CA); Jiayin Guo, Sherbrooke (CA); Jerzy Jurewicz, Sherbrooke (CA); Gang Han, Tottori (JP); Shujiroh Uesaka, Shimane (JP); Hiroshi Takashima, Tottori (JP)

(73) Assignees: Hitachi Metals, Ltd., Tokyo (JP); Tekna Plasma Systems Inc., Sherbrooke (CA)

( * ) Notice: Subject to any disclaimer, the term of this patent is extended or adjusted under 35 U.S.C. 154(b) by 0 days.

(21) Appl. No.: 12/414,214

(22) Filed: Mar. 30, 2009

(65) Prior Publication Data

US 2009/0260481 A1 Oct. 22, 2009

Related U.S. Application Data

(60) Provisional application No. 61/041,051, filed on Mar. 31, 2008.

(51) Int. Cl.
*C22B 34/12* (2006.01)

(52) U.S. Cl. ..... 75/10.19; 75/10.47; 75/10.62

(58) Field of Classification Search ..... 75/10.19, 75/10.62, 10.47
See application file for complete search history.

(56) References Cited

U.S. PATENT DOCUMENTS

| | | | | |
|---|---|---|---|---|
| 4,080,194 | A | 3/1978 | Fey | 75/10.19 |
| 4,356,029 | A | 10/1982 | Down et al. | 75/346 |
| 6,712,952 | B1 | 3/2004 | Fray et al. | 205/640 |
| 6,824,585 | B2 * | 11/2004 | Joseph et al. | 75/10.19 |
| 6,866,885 | B1 * | 3/2005 | Clough | 427/212 |
| 2008/0298425 | A1 * | 12/2008 | Jackson | 373/108 |

FOREIGN PATENT DOCUMENTS

| | | |
|---|---|---|
| JP | 7-252550 | 10/1995 |
| JP | 7-278691 | 10/1995 |

OTHER PUBLICATIONS

MgCl2. Perry's Chemical Engineers' Handbook (8th Edition). 2008. Table 2-1 Physical Properties of the Elements and Inorganic Compounds.*

Titanium. ProKon, Version 8.66 Copyright 1997-98 Harold Schwartz. The Calculation Companion.*

* cited by examiner

*Primary Examiner* — George Wyszomierski
*Assistant Examiner* — Tima M McGuthry Banks
(74) *Attorney, Agent, or Firm* — Fulbright & Jaworski L.L.P.

(57) ABSTRACT

A process and apparatus for producing titanium metal is described herein. The process comprises generating an RF thermal plasma discharge using a plasma torch provided with an RF coil; reducing titanium tetrachloride to a titanium metal by supplying titanium tetrachloride and magnesium into the RF thermal plasma discharge; and collecting or depositing the titanium metal at a temperature not lower than the boiling point of magnesium chloride and not higher than the boiling point of the titanium metal.

4 Claims, 5 Drawing Sheets

Prior Art

METHOD FOR PRODUCING TITANIUM METAL

CROSS REFERENCE TO RELATED APPLICATIONS

The present application claims the benefit of U.S. Provisional Application No. 61/041,051 filed on Mar. 31, 2008, the entire contents of which are incorporated by reference.

FIELD OF THE INVENTION

The present disclosure generally relates to a process and apparatus for producing titanium metal. More specifically, but not exclusively, the present disclosure relates to a process and apparatus for producing titanium metal through the reduction of titanium tetrachloride using magnesium metal in an RF inductively coupled plasma reactor.

BACKGROUND OF THE INVENTION

Titanium is a light metal having a high mechanical strength to weight ratio and exhibiting superior corrosion resistance. Titanium is widely used in various fields including the airplane, medical and automobile industry. The amount of titanium being used has been steadily increasing at a yearly rate of 5%. Titanium is commonly found in the earth's crust, being the $10^{th}$ most abundant element. Although the demand for titanium has been steadily increasing, its production has not increased sufficiently to satisfy the demand. The Kroll method, the currently used industrial titanium refining method, suffers from low production efficiency and the production of titanium metal in the form of a porous sponge.

In the Kroll method, titanium ore, the main component of which is titanium dioxide ($TiO_2$), is reacted with chlorine gas and coke (C) to provide titanium tetrachloride ($TiCl_4$) which is subsequently purified. The purified titanium tetrachloride is reduced using magnesium to provide titanium metal. The process can be summarized as follows:

$$TiCl_4+2Mg \rightarrow Ti+2MgCl_2$$

The various process steps for the production of titanium metal following the Kroll method are illustrated in FIG. 1. Titanium ore, comprising titanium dioxide $TiO_2$, is reacted with chlorine gas and coke to provide titanium tetrachloride (step 2). The titanium tetrachloride product is refined and purified (step 3). Titanium tetrachloride, in a liquid state at room temperature, is subsequently reduced in a reaction vessel comprising molten magnesium (step 4). The reduced titanium tetrachloride generates sponge titanium. The magnesium chloride by-product, as well as any unreacted magnesium, is removed from the sponge titanium product by transferring the reaction mixture to another vessel which is heated at a temperature above the boiling point of magnesium chloride. The magnesium chloride vapor is drawn-off by the application of a vacuum (step 5). The resulting titanium sponge is removed from the vessel and cut into large chunks or ground into a powder (step 6). Alloying elements such as aluminum or vanadium can optionally be added (step 7). The product is compacted to form an electrode (step 8) which is subsequently melted (step 9). The molten material is either atomized to produce a fine spherical powder (step 10) which is subsequently sintered (step 11), or cast (step 12) to provide a material which is worked to provide a wrought material (step 13). The Kroll method is a complicated batch process which requires many process steps and which requires extensive amounts of production time. A batch comprising 9 tons of titanium will typically require 7-9 production days.

The Kroll method typically comprises the use of a stainless steel vessel filled with a magnesium melt maintained at a temperature of 800° C. Titanium tetrachloride, in the liquid phase, is introduced into the vessel and reacts with the magnesium melt to generate titanium metal. The freshly generated titanium metal sinks in the magnesium melt, while the concomitantly produced magnesium chloride remains in the melt in the liquid phase. Thus, the resultant reaction mixture comprises titanium metal and a liquid phase composed of magnesium and magnesium chloride. Upon completion of the reaction, the reaction mixture is subjected to an in vacuo, high temperature separation process to provide a sponge cake of porous titanium. Since titanium is an active metal that easily reacts with oxygen or nitrogen, it is important that exposure to the air be kept at a minimum. The reaction vessel is thus sealed following the introduction of the titanium tetrachloride feed material.

A large amount of porous titanium sponge cake is obtained following the magnesium mediated reduction reaction and subsequent separation process. However, as the amounts of oxygen and other impurities vary between the core and the periphery of the cake, the material is not suitable for use as an electrode for vacuum arc re-melting (VAR). The sponge cake must be crushed such that the core and the periphery become fractionated.

The production of titanium metal by means of the Kroll method requires long periods of time, typically 10 days, as the reduction and separation process are carried-out batch wise and the process requires a subsequent crushing step. These process limitations adversely affect the production cost.

In an embodiment of the Kroll method, a pair of stainless steel vessels is used such that the porous titanium sponge cake, obtained following the reduction process, can also be subjected to the separation process. While this embodiment provides for a titanium product of enhanced quality, the production efficiency does not meet the increasing market demand.

Several alternative methods have been developed for the production of titanium metal.

U.S. Pat. No. 6,712,952 issued to Fray et al. on Mar. 30, 2004 discloses a method for obtaining titanium metal through the electrolysis of titanium oxide in a molten salt bath. However, product quality and process efficiency are some of the drawbacks rendering the method unsuitable for large scale production.

JP-A-7-252550 discloses a method for producing titanium metal by reducing titanium tetrachloride using an alkali metal or alkali earth metal. A mixture of titanium metal and alkali metal or alkali earth metal halide is obtained. The mixture is fed into a crucible having open upper and lower ends and heated using a plasma torch such that the titanium metal is melted and the halide by-product is vaporized. The molten titanium metal is drawn downward and isolated as an ingot. The separation of the by-product and the formation of the ingot are thus performed in a single process step.

JP-A-7-278691 discloses a further method for producing titanium metal by reducing titanium tetrachloride using magnesium metal. Titanium metal is introduced into a crucible having open upper and lower ends and molten (e.g. RF heating or RF plasma heating). Titanium tetrachloride and magnesium metal are subsequently fed into the molten pool of titanium. The magnesium chloride by-product is vaporized and removed. The method provides for the continuous production of titanium ingots.

JP-A-58-110626 discloses a further method for producing titanium metal in which a gas mixture (e.g. Ar, He and/or $H_2$) is passed between arc-heater electrodes to generate an arc jet which is subsequently discharged into a reactor vessel. Molten Mg or Na and titanium tetrachloride are fed into the vessel. The titanium tetrachloride feed is reduced by the sodium or magnesium and titanium metal is deposited on the wall of the vessel.

U.S. Pat. No. 4,080,194 issued to Fey on Mar. 21, 1978 discloses a method for obtaining titanium metal by injecting titanium tetrachloride and magnesium or sodium into a reaction chamber heated by an arc jet. The reduced titanium is collected in a mold as a titanium ingot.

The present disclosure refers to a number of documents, the content of which is herein incorporated by reference in their entirety.

SUMMARY OF THE INVENTION

The present disclosure relates to a novel process and apparatus for producing titanium metal. In an embodiment, the present disclosure relates to a novel process and apparatus for producing titanium metal in ingot or dense powder form. In a further embodiment, the present disclosure relates to a continuous process for the reduction of titanium tetrachloride using magnesium metal in an RF inductively coupled plasma reactor. In a further embodiment, the present disclosure relates to a process suitable for large scale production of titanium metal. In yet a further embodiment, the present disclosure relates to a process for the reduction of titanium tetrachloride, in which process the reduction of the titanium tetrachloride feed material is performed using magnesium metal and in which process the subsequent condensation of the formed titanium metal, in the form of molten titanium droplets, provides for the collection of the titanium metal as solid particles or as a dense ingot and the concomitant online separation from the magnesium chloride by-product which remains in the vapor phase.

As broadly claimed, the present disclosure relates to a process for producing titanium metal comprising:

generating an RF inductively coupled thermal plasma discharge using an induction plasma torch provided with an RF coil;

introducing titanium tetrachloride and magnesium metal powder into the plasma discharge;

reducing titanium tetrachloride to titanium metal; and collecting or depositing the titanium metal at a temperature not lower than the boiling point of magnesium chloride and not higher than the boiling point of the titanium metal.

In an embodiment of the present disclosure, the plasma discharge is created using Argon, Hydrogen, Helium or mixtures thereof.

In an embodiment of the present disclosure, the titanium tetrachloride feed material may be in either liquid or vapor form.

In an embodiment of the present disclosure, the magnesium feed material may be in solid powder form or in the form of molten droplets.

In an embodiment of the present disclosure, the selective condensation of the produced titanium metal vapor in the form of titanium metal droplets is achieved through proper control of the wall temperature of the reactor.

As broadly claimed, the present disclosure relates to an apparatus for producing titanium metal, the apparatus comprising:

an upper section provided with an induction plasma torch comprising an RF coil for generating an RF thermal plasma discharge, a gas feeding unit for supplying plasma gas, and a precursor feeding unit for supplying titanium tetrachloride and magnesium into the RF thermal plasma discharge;

a chamber connected downstream the upper section comprising a receptacle for collecting titanium metal, said receptacle being located in a temperature zone not lower than the boiling point of magnesium chloride and not higher than the boiling point of the titanium metal; and an exhaust unit, the exhaust unit being connected to the chamber.

In an embodiment, the present disclosure relates to a continuous process for producing titanium metal, in which process titanium tetrachloride is reduced to titanium metal using magnesium as the reducing agent.

In an embodiment, the present disclosure relates to a continuous process for producing high purity titanium metal. The process and apparatus of the present disclosure offer the additional advantages of the in-situ removal of magnesium chloride by-product, being scalable and simple to operate.

In an embodiment, the present disclosure relates to a continuous process for producing titanium metal, in which process the reduced titanium product is concomitantly melted in a separation step.

In an embodiment, the present disclosure relates to a continuous process for producing titanium metal in powder or ingot form.

In an embodiment, the present disclosure relates to a continuous process for producing titanium metal powder or a titanium ingot, in which process the reduced titanium product is concomitantly melted in a separation step and the product subsequently sintered.

The foregoing and other objects, advantages and features of the present disclosure will become more apparent upon reading of the following non restrictive description of illustrative embodiments thereof, given by way of example only with reference to the accompanying drawings.

DETAILED DESCRIPTION OF ILLUSTRATIVE EMBODIMENTS

In order to provide a clear and consistent understanding of the terms used in the present specification, a number of definitions are provided below. Moreover, unless defined otherwise, all technical and scientific terms as used herein have the same meaning as commonly understood to one of ordinary skill in the art to which this disclosure pertains.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements or process steps.

The term "about" is used to indicate that a value includes an inherent variation of error for the device or the method being employed to determine the value.

The present disclosure relates to a novel process and apparatus for producing titanium metal.

Figure 1:
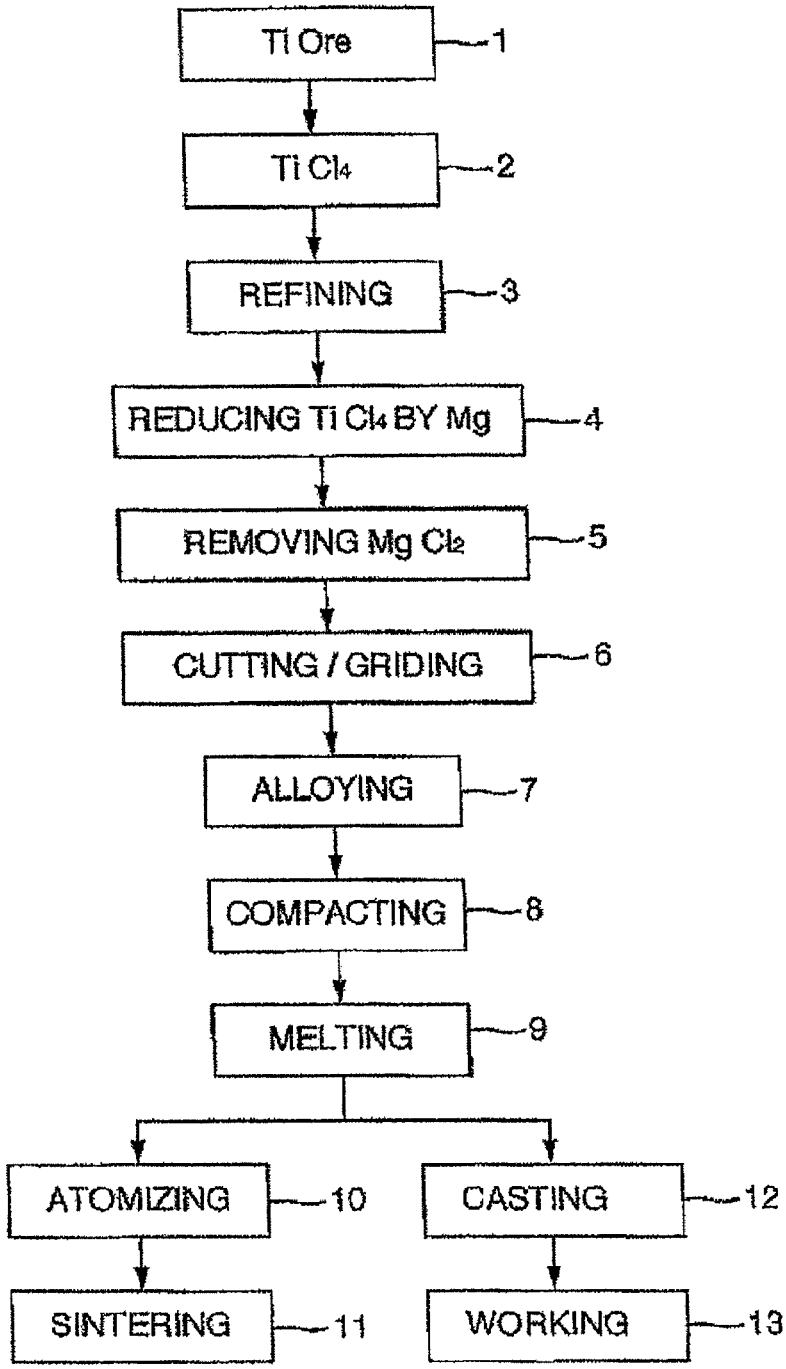
FIG. 1 illustrates a flow chart of the various steps for producing titanium metal following the prior art Kroll method.
Figure 2:
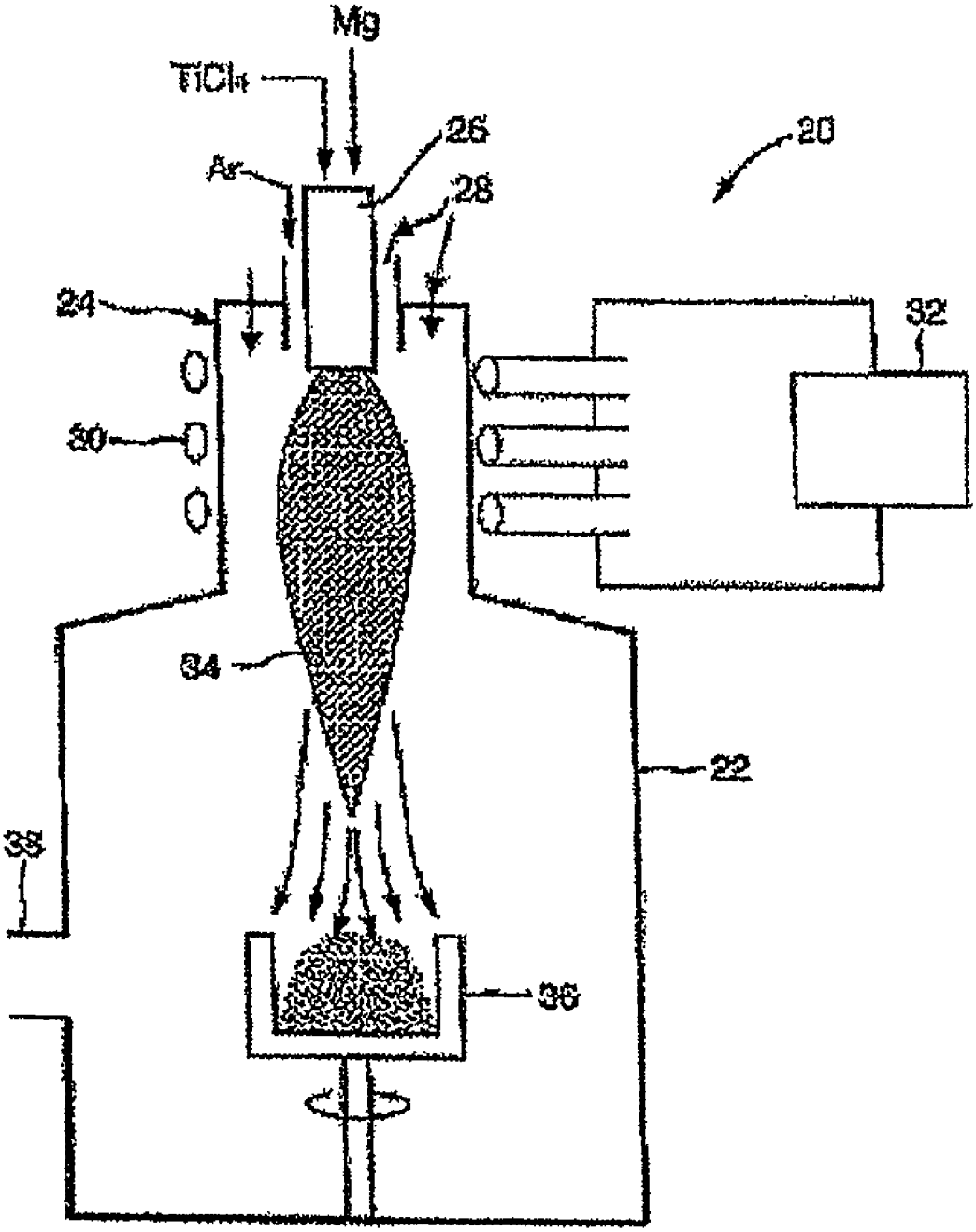
FIG. 2 illustrates a cross-sectional side-elevation view of an apparatus for producing titanium metal in accordance with an embodiment of the present disclosure.
Figure 3:
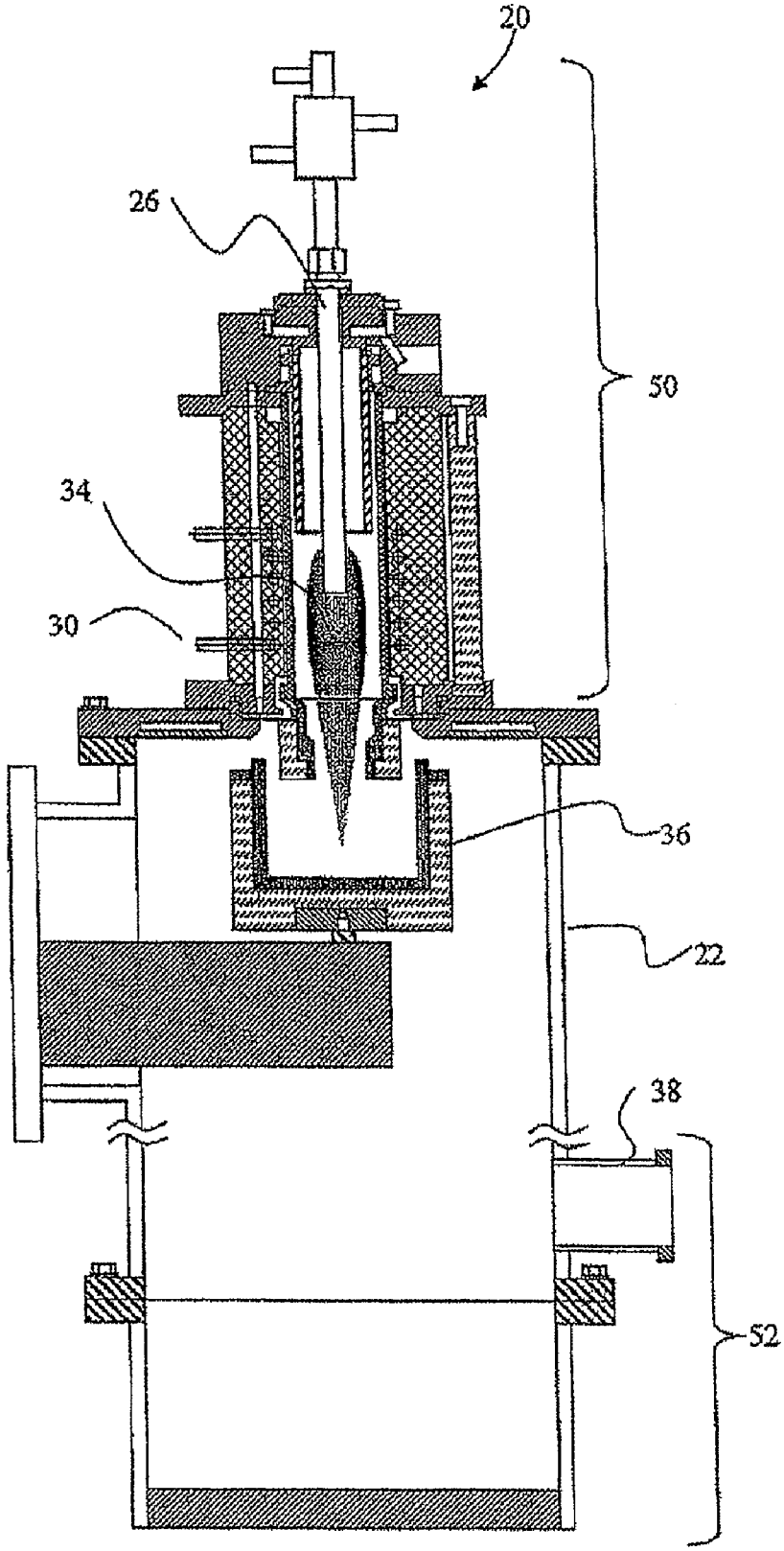
FIG. 3 illustrates a cross-sectional side-elevation view of an apparatus for producing titanium metal in accordance with an embodiment of the present disclosure.
Figure 4:
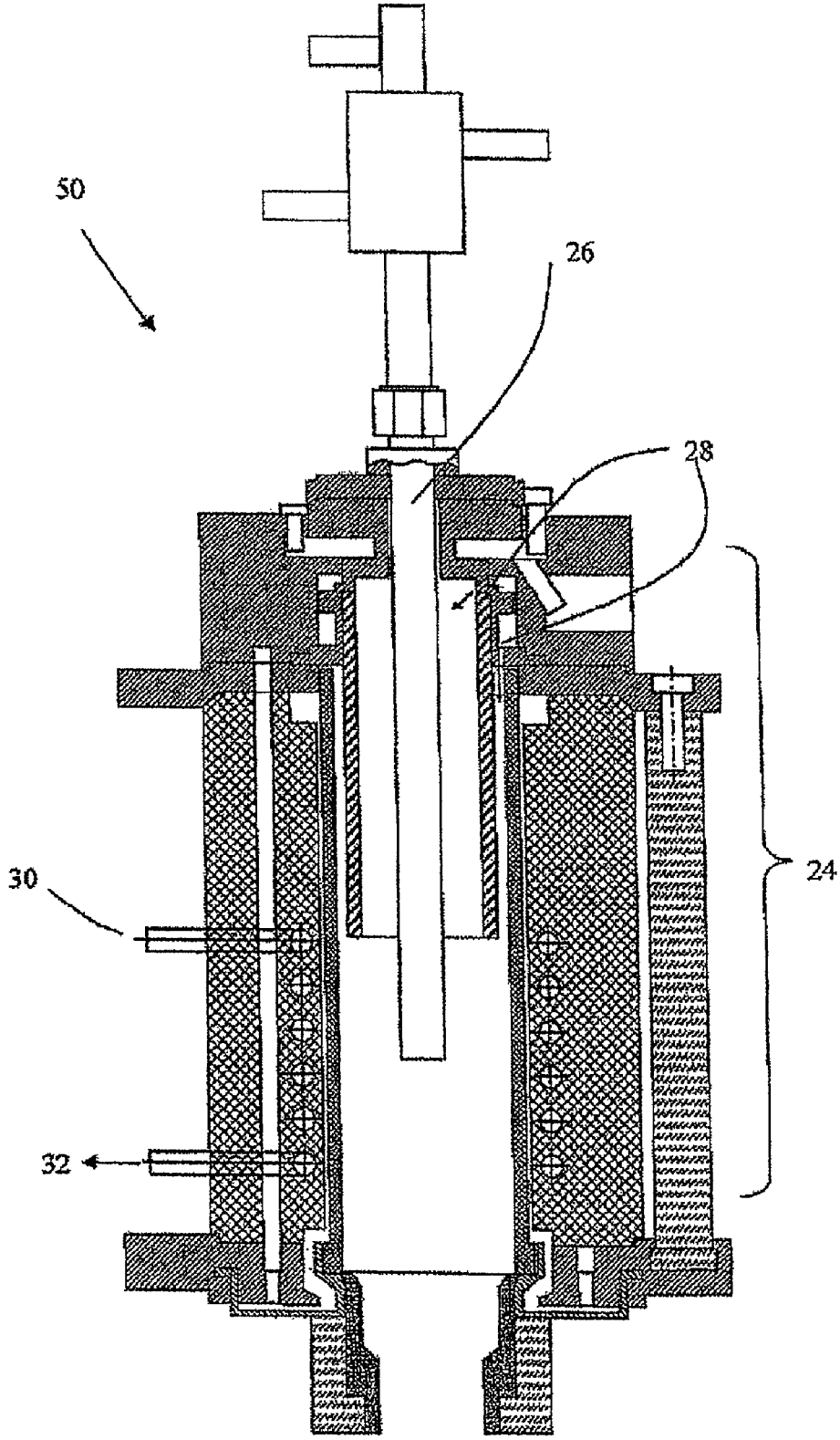
FIG. 4 illustrates an extended cross-sectional side-elevation view of the upper section of the apparatus illustrated in FIG. 3.
Figure 5:
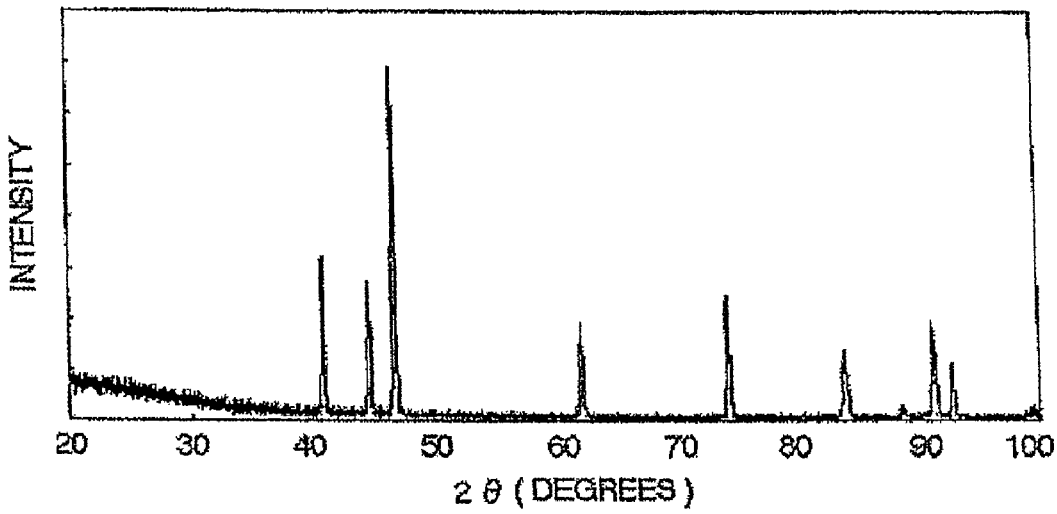
FIG. 5 is an X-Ray Diffraction Pattern of a titanium deposit on a graphite crucible produced in accordance with Example 2 of the present disclosure.

A cross-sectional side-elevation view of an apparatus 20 for producing titanium metal from titanium tetrachloride in accordance with an embodiment of the present disclosure is illustrated in FIGS. 2 and 3. The apparatus comprises an upper section 50 provided with a plasma torch 24 equipped with an RF coil 30 for generating an RF thermal plasma discharge, a gas feeding unit 28 for supplying plasma gas, and a feeding unit 26 for supplying titanium tetrachloride and magnesium into the RF thermal plasma discharge. The apparatus further comprises a chamber 22 operationally connected downstream the upper section 50, and an exhaust unit 52 operationally connected downstream the chamber 22. The chamber 22 is equipped with a port 38 through which a vacuuming unit can be connected. In an embodiment of the present disclosure, the vacuuming unit (not shown) is a vacuum pump. The vacuuming unit allows for the magnesium chloride vapors collecting in the exhaust unit 52 to be evacuated from the apparatus.

In an embodiment of the present disclosure, a heater may be provided surrounding at least a part of chamber 22, such that the chamber 22 may be heated to a predetermined temperature. In an embodiment of the present disclosure, the inner wall of chamber 22 comprises a material resistant to the corrosion effect of the chloride vapors. In a more particular embodiment of the present disclosure, the corrosion resistant material comprises graphite. In a further embodiment of the present disclosure, chamber 22 is heated using a heater comprising a coil positioned within or outside chamber 22. In the latter case, the heating of chamber 22 may be achieved through electromagnetic induction heating of the inner graphite wall of chamber 22. The combined heat provided by the heater, the thermal plasma discharge and the exothermal reduction reaction may be controlled to keep chamber 22 at a predetermined temperature. In an embodiment of the present disclosure, the temperature in chamber 22 should not be lower than the boiling point of magnesium chloride In an embodiment of the present disclosure, the plasma torch 24 comprises an RF coil 30 around a substantially cylindrical water-cooled tube. In a more particular embodiment of the present disclosure, the plasma torch 24 comprises an RF coil 30 around a substantially cylindrical glass water-cooled tube. In a more particular embodiment of the present disclosure, the plasma torch 24 comprises an RF coil 30 around a substantially cylindrical ceramic water-cooled tube. The RF coil 30 is connected to an RF power source 32 and generates an electromagnetic induced plasma discharge in the cylindrical tube.

The torch 24 is provided with a feeding unit 26 for supplying titanium tetrachloride and magnesium into the RF thermal plasma discharge. The titanium tetrachloride feed material may be supplied in either a liquid or gaseous state through a first nozzle of the feeding unit 26 together with a carrier gas (e.g. argon gas). Magnesium, in melt or powder form, is supplied into the RF thermal plasma discharge through a second nozzle of feeding unit 26. Thus, the titanium tetrachloride and magnesium feed materials are supplied by their respective inlets such that they are not mixed prior to entering the plasma discharge. The feed materials are mixed when entering the plasma region and the reduction reaction is processed in the high temperature plasma discharge. Flash vaporization of both the titanium tetrachloride and magnesium metal feed materials in the plasma discharge is followed by the reduction of the titanium tetrachloride vapor by the magnesium vapor, resulting in the formation of titanium metal vapor and magnesium chloride vapor. In an embodiment of the present disclosure, the titanium tetrachloride and magnesium feed materials are supplied through nozzles of feeding unit 26 along a central axis of the plasma discharge. In a further embodiment of the present disclosure, the titanium tetrachloride and magnesium feed materials are supplied along a central axis of the plasma discharge from a plurality of nozzles of feeding unit 26. In a further embodiment of the present disclosure, the nozzles comprise a plurality of passages. In yet a further embodiment of the present disclosure the nozzles comprise a single passage.

The torch 24 is further provided with a plasma gas feeding unit 28. In an embodiment of the present disclosure, the gas feeding unit 28 is positioned adjacent to feeding unit 26 and is directed such that the plasma gas is fed into the torch 24 in the axial direction as central and sheath gas streams.

A holder 36 for collecting the generated titanium metal is positioned in chamber 22. The holder 36 should be resistant to temperatures exceeding the melting point of the titanium metal product. In an embodiment of the present disclosure, the holder comprises a crucible composed of graphite. Graphite is resistant to high plasma temperatures and thus prevents contamination of the titanium metal product. Experimental observations suggest that the contact area of the holder 36 be kept small as no carbide formation could be observed resulting from the reaction between carbon and titanium. As the feed materials are supplied along a central axis of the plasma discharge, positioning the holder 36 along the same axis will ensure that the substantially all of the generated titanium metal may be collected. In a further embodiment of the present disclosure, the holder comprises a crucible composed of titanium. Other materials suitable for collecting the generated titanium metal can be used and are within the capacity of a skilled technician.

In an embodiment of the present disclosure, a coalescing nozzle may be operationally positioned between the reactor section comprising plasma torch 24 and holder 36 in order to enhance titanium collection efficiency. Independent and precise temperature control of the reactor section and the region comprising holder 36 is required in order to avoid clogging of the coalescing nozzle, to ensure completion of the reduction process and to increase the titanium collection efficiency.

The present disclosure uses RF plasma to reduce a titanium tetrachloride feed material into titanium metal. The use of a DC plasma to reduce a titanium tetrachloride feed material into titanium metal is within the scope of the present disclosure. However, since a DC plasma flame discharge is generated by applying a high voltage between the electrodes, the generated titanium metal may include contaminants as a result of molten electrode. RF plasma is generated by electromagnetic induction using an induction coil powered by a RF power supply. Since the RF induced plasma discharge does not come into contact with electrodes, the titanium product will be substantially free from contamination. Moreover, since the RF induced plasma discharge exhibits a skin effect, the periphery of the discharge will be at a higher temperature compared to the region defined by the center of the discharge. Therefore, the outlets of the feeding unit for supplying the titanium tetrachloride and magnesium feeds may be inserted into the center of the discharge, providing for a stable supply of feed materials into the plasma discharge. Finally, contrary to a DC plasma discharge, a RF plasma discharge may be generated using lower power densities and larger discharge volumes resulting in overall lower space velocities of the plasma discharge, ensuring that the feed materials remain in the plasma discharge for longer periods of time, ensuring a more complete reaction process. The use of a RF plasma discharge provides for a more stable reduction of titanium tetrachloride than would be obtained using a DC plasma discharge.

The plasma gas is supplied via a gas feeding unit 28 and the RF power is supplied using a RF power source 32. In an embodiment of the present disclosure, the plasma gas may be selected from the group consisting of argon (Ar), helium (He), hydrogen ($H_2$), and mixtures thereof. Other plasma gasses are known in the art, and are within the capacity of a skilled technician. In an embodiment of the present disclosure, an inert gas is used since it does not give rise to any unwanted reactions with titanium, resulting in contamination of the titanium metal product. In a more specific embodiment of the present disclosure, a mixture of argon and helium gas is used.

Using a mixture of argon and helium gas, the shape, thermal conductivity, flow resistance, and ionization states of the plasma discharge can be controlled by the careful monitoring of factors such as the operating pressure or the Ar/He ratio.

Magnesium metal powder and titanium tetrachloride are supplied from the feeding unit 26. In an embodiment of the present disclosure, the feed materials are supplied along a central axis of the RF thermal plasma discharge 34. The plasma discharge has a temperature ranging from about 3000 to about 10000° C. By injecting the feed materials along the central axis of the plasma discharge, the materials will remain in the discharge for longer periods of time, thus ensuring a more complete reaction process.

In an embodiment of the present disclosure, magnesium metal is used as the reducing agent. Other reducing agents, non-limiting examples of which include alkali metals such as sodium and potassium, alkali earth metals such as calcium, and light metals such as aluminum may also be used in the process of the present disclosure. Yet further reducing agents are known in the art, and are within the capacity of a skilled technician.

The titanium metal product may be collected either as a powder, as a sponge metal or as an ingot, depending on the distance between the plasma discharge 34 and the holder 36. When the holder 36 is positioned near the plasma discharge 34, such that molten or partially molten titanium particles collide with the holder 36, the titanium product is collected as a bulk metal comprising pores (i.e. a sponge metal is deposited in the holder). Positioning the holder 36 at greater distances from the plasma discharge 34 provides for the collection of a titanium metal powder since the titanium particles are capable of solidifying prior to colliding with the holder 36 (i.e. a powder is deposited in the holder). Alternatively, the holder 36 may be independently heated using an inductively coupled RF electric heater and maintained at a precise temperature. This provides for an independent control over the form of the titanium metal collected.

Titanium readily reacts with oxygen and nitrogen, forming oxide or nitride contaminants. In order to avoid such unwanted side reactions, exposure of the titanium product to the air should be minimized or avoided. In accordance with an embodiment of the present disclosure, the plasma gas and any product gases (e.g. magnesium chloride) are evacuated from the chamber 22 through port 38. In an embodiment of the present disclosure, chamber 22 is kept at a pressure slightly above 1 atmosphere. By keeping the apparatus 20, including the upper section 50 and the chamber 22 at a pressure slightly above 1 atmosphere, any contact of the titanium product with the air is substantially avoided, such that titanium metal can be continuously produced.

The chamber 22 should be kept at a temperature not lower than the boiling point of magnesium chloride and not higher than the boiling point of the titanium metal. This would allow for the complete separation of the titanium metal product from the vapor stream comprising unreacted magnesium metal and magnesium chloride by-product. At a pressure of 1 atmosphere, titanium has a melting point of 1668° C. and a boiling point of 3262° C., while magnesium chloride, magnesium, and titanium tetrachloride have a boiling point of 1412° C., 1080° C. and 136° C. respectively. The temperature at the holder 36 should not be lower than the boiling point of magnesium metal or magnesium chloride, and not higher than the boiling point of titanium metal, such that only the generated titanium metal exists in the liquid or solid state. The temperature at the holder 36 should be such that all by-products and unreacted materials are in the gas state. Since the by-products and unreacted materials are in the gas state, they can be readily separated from the titanium metal product and removed from the chamber 22 using an exhaust unit 52 connected to chamber 22 through port 38. Since the boiling point of titanium is 3262° C., the temperature in chamber 22 should not exceed 3262° C. In an embodiment of the present disclosure, the temperature in chamber 22 should not exceed 2000° C. In a further embodiment of the present disclosure, the temperature in chamber 22 should not exceed 1668° C.

The discharged gases from chamber 22 may be treated in order to recover the magnesium chloride. The recovered magnesium chloride may be reduced to produce magnesium metal which can be reused for the reduction of titanium tetrachloride.

The titanium metal product collected from holder 36 may be subjected to a melting process. In an embodiment of the present disclosure, the molten metal is atomized to produce a titanium powder. By carefully positioning the holder 36 in chamber 22, a titanium powder may be directly produced by the process of the present disclosure. In a further embodiment of the present disclosure, the molten metal is cast and then processed to produce a wrought material.

EXPERIMENTAL

A number of examples are provided hereinbelow, illustrating the efficiency of the process and apparatus of the present disclosure in the preparation of titanium metal. FIG. 3 represents a cross-sectional side-elevation view of the apparatus used in the following examples for producing titanium metal. The apparatus comprises a plasma torch having a cylindrical ceramic tube (diameter=50 mm) having an induction coil wrapped around it (5 turns), the coil being connected to a RF power source of 60 kW. A feeding unit 26 is mounted to the torch such that the outlet of the unit is substantially in alignment with the center of the ceramic tube. A chamber 22 is operationally connected downstream the upper section 50 including the plasma torch; the chamber comprises a graphite holder 36 positioned under the plasma discharge along a central axis thereof. The chamber comprises a port 38 for connecting an exhaust unit 52.

The titanium tetrachloride feed material was supplied to the feeding unit using a pressure pump, whereas the magnesium powder (having a diameter $D_{50}$ of 40 μm) was supplied to the feeding unit using a rotary powder feeder. The vacuumed gases (including magnesium dichloride gas) were passed through a cyclone heat exchanger followed by a filter in order to cool the gases and recover any N-reacted magnesium metal and magnesium chloride powder by-product. $D_{50}$ represent 50% of the volume of the particles in the sample that have a diameter less than the stated value for $D_{50}$ (i.e. of 40 μm).

Table 1 summarizes the conditions used for generating the plasma, including the power supply, the gas pressure, the plasma gas composition, the flow rate of the feed materials (i.e. titanium tetrachloride and magnesium) and the amount of titanium metal deposited in the graphite crucible for examples 1 and 2. A mixed gas composition of argon and helium was used for generating the plasma gas. The Ar/He gas mixture (77/15 l/min (STP) example 1; and 68/15 l/min (STP) example 2) was injected at a pressure of 101 kPa. An RF power source of 50 kW (example 1) and 46 kW (example 2) was applied to the induction coil to generate the plasma discharge. Titanium tetrachloride and magnesium were fed into the plasma torch over a period of 22 minutes at 36.6 g/min and 7.5 g/min respectively, (example 1), and over a period of 30 minutes at 40.0 g/min and 9.7 g/min respectively (example 2). The titanium product collected in the graphite crucible was subjected to quantitative analysis using Inductive Coupled Plasma (ICP) emission spectroscopic elemental analysis.

The temperature of the outer wall of the graphite crucible was measured using a thermocouple. The average temperature of the outer wall of the graphite crucible was 1100° C. (example 1) and 1080° C. (example 2). The titanium metal deposited in the graphite crucible showed traces of melting on its surface which is indicative of the temperature at the center of the graphite crucible having been greater than the melting point of titanium metal (1668° C.).

TABLE 1

Experimental Conditions

| | Conditions | | | | | | | |
|---|---|---|---|---|---|---|---|---|
| | Power supply | Gas pressure | Plasma gas composition (l/min) | | Flow rate of $TiCl_4$ | Flow rate of Mg | Processing time | Amount of Ti deposition |
| | (kW) | (kPa) | Ar | He | (g/min) | (g/min) | (min) | (g) |
| Example 1 | 50 | 101 | 77 | 15 | 36.6 | 7.5 | 22 | 40 |
| Example 2 | 46 | 101 | 68 | 15 | 40.0 | 9.7 | 30 | 73 |

Inductive Coupled Plasma (ICP) spectrochemical elemental analysis revealed that 97.92% and 98.74% of the deposition was composed of titanium (examples 1 and 2 respectively). X-ray diffraction analysis of the product revealed a single phase titanium diffraction pattern. Both the Inductive Coupled Plasma (ICP) spectrometry analysis and the X-ray diffraction analysis confirmed the high purity of the titanium metal product.

It is to be understood that the disclosure is not limited in its application to the details of construction and parts as described hereinabove. The disclosure is capable of other embodiments and of being practiced in various ways. It is also understood that the phraseology or terminology used herein is for the purpose of description and not limitation. Hence, although the present disclosure has been described hereinabove by way of illustrative embodiments thereof, it can be modified, without departing from the spirit, scope and nature of the subject disclosure as defined in the appended claims.

What is claimed is:

1. A process for producing titanium metal comprising:

(a) generating a RF thermal plasma discharge using a plasma torch comprising an RF coil;

(b) reducing titanium tetrachloride to a titanium metal by supplying both titanium tetrachloride and magnesium through an outlet of a feeding unit inserted into the center of the RF thermal plasma discharge and along a central axis of the RF thermal plasma discharge; and (c) collecting or depositing the titanium metal at a temperature not lower than the boiling point of magnesium chloride and not higher than the boiling point of the titanium metal.

2. The process of claim 1, in which the supplied magnesium is a powder or a molten liquid.

3. The process of claim 1, in which the supplied titanium tetrachloride is a liquid or a vapor.

4. The process of claim 3, in which the titanium metal is collected at a temperature ranging from 1412° C. to 2000° C.

* * * * *